United States Patent [19]

Guillaume et al.

[11] 4,302,303

[45] Nov. 24, 1981

[54] PERMEABLE DIAPHRAGM FOR AN ELECTROCHEMICAL CELL

[75] Inventors: Robert Guillaume, Brussels; Jean-Pierre Pleska, Paturages; Jean Indeherbergh, Brussels, all of Belgium

[73] Assignee: Solvay and Cie, Brussels, Belgium

[21] Appl. No.: 197,826

[22] Filed: Oct. 17, 1980

Related U.S. Application Data

[62] Division of Ser. No. 62,039, Jul. 30, 1979, abandoned.

[30] Foreign Application Priority Data

Jul. 31, 1978 [FR] France ..... 78 22919

[51] Int. Cl.[3] ..... C25B 1/02; C25B 1/26; C25B 13/08

[52] U.S. Cl. ..... 204/128; 204/129; 204/266; 204/296

[58] Field of Search ..... 204/128, 129, 296, 252, 204/258, 270, 266

[56] References Cited

U.S. PATENT DOCUMENTS

| | | | |
|---|---|---|---|
| 3,450,650 | 6/1969 | Murata | 204/296 X |
| 3,944,477 | 3/1976 | Argade | 204/266 |
| 4,125,451 | 11/1978 | Patil et al. | 204/296 |
| 4,126,535 | 11/1978 | Balko et al. | 204/296 |
| 4,154,666 | 5/1979 | Patil et al. | 204/296 X |

*Primary Examiner*—Arthur C. Prescott

*Attorney, Agent, or Firm*—Robert E. Burns; Emmanuel J. Lobato; Bruce L. Adams

[57] ABSTRACT

The invention relates to a permeable diaphragm for an electrochemical cell.

The diaphragm consists of a sheet of fibrous, organic polymeric material, obtained from a suspension of the said polymeric material in an organic liquid.

The invention applies to permeable diaphragms for cells for the electrolysis of aqueous sodium chloride solutions.

17 Claims, No Drawings

PERMEABLE DIAPHRAGM FOR AN ELECTROCHEMICAL CELL

This is a divisional of application Ser. No. 062,039, filed July 30, 1979, now abandoned.

BACKGROUND OF THE INVENTION

The present invention relates to a permeable diaphragm for an electrochemical cell, in particular for a cell for the electrolysis of aqueous solutions of alkali metal halides.

It relates more particularly to a permeable diaphragm, for an electrochemical cell, which is made of a fibrous, organic polymeric material.

It is known to use diaphragms based on organic polymers in the fibrous state in electrochemical cells.

Thus, U.S. Pat. No. 4,036,729, in the name of Patil et al., filed on Apr. 10, 1975 and published on July 19, 1977, relates to a permeable diaphragm which consists of a felt formed, on the perforated cathode of an electrolysis cell, from a dispersion of a fibrous polymeric material in an aqueous medium containing acetone and a surface-active agent.

This known diaphragm exhibits the disadvantage that it requires the incorporation of a surface-active agent in the aqueous medium used for its manufacture, so as to permit adequate dispersion of the polymeric material in this medium. It exhibits the additional disadvantage that it requires the addition, to the fibrous polymeric material, of an additive which can be wetted by the aqueous electrolytes, so that the diaphragm can be sufficiently wetted by these electrolytes. Practice has shown that, in the absence of a wettable additive (such as asbestos fibers, mica, talc or particles of titanium dioxide), the diaphragm is generally too hydrophobic to permit its normal use in electrochemical cells for treating aqueous electrolytes, in particular in cells for the electrolysis of aqueous solutions of alkali metal halides.

Furthermore, the known diaphragm described above exhibits the disadvantageous characteristic that it can only be produced from a very specific and expensive variety of polymic fibers, namely fibers obtained by the melt extrusion of a polymer subjected to an intense shear stress in an auxiliary liquid medium. This characteristic of the known diaphragm has the disadvantageous consequence of increasing its cost.

Japanese Patent Application No. 49/124,302, filed on Apr. 6, 1973 by Mitsubishi Rayon Co., Ltd, describes a process for the manufacture of porous sheets, in accordance with which a fibrous polymeric material, generally a fluorinated polymer, is dispersed in an organic liquid, for example a halogenchydrocarbon, and a felt is separated from the resulting organic suspension.

SUMMARY OF THE INVENTION

It has now been discovered that the porous sheets, made of a fibrous, organic polymeric material and obtained by this known process, exhibit the advantageous characteristic that they have an excellent behaviour when used as permeable diaphragm in electrochemical cells, and more particularly in cells for the electrolysis of aqueous solutions of alkali metal halides.

The object of the invention is therefore to provide a permeable diaphragm, made of a fibrous, organic polymeric material, for an electrochemical cell, which diaphragm simultaneously possesses an excellent wettability with respect to aqueous electrolytes, in particular brines, and an optimum permeability to these aqueous electrolytes during electrolysis.

Consequently, the invention relates to a diaphragm, made of a fibrous, organic polymeric material, for an electrochemical cell, the said diaphragm consisting of a porous sheet obtained from a suspension of the fibrous polymeric material in an organic liquid.

DESCRIPTION OF THE INVENTION

The fibrous, organic polymeric material used within the scope of the invention can be in the form of fibers or fibrils.

The term fibrils is understood as denoting a specific structure of the polymer material. The fibrils consist of an aggregate of a multitude of very thin filaments, of film-like appearance, which are connected to one another so as to form a three-dimensional network. Of flake-like appearance, the fibrillar aggregates have an oblong shape; their length varies from about 0.5 to 50 mm and their diameter varies from about a few microns to 5 mm. They are characterized by a high specific surface area which is greater than 1 $m^2/g$ and, in many cases, even greater than 10 $m^2/g$.

The fibrils used within the scope of the invention can be manufactured, for example, by subjecting a mixture of a polymer in the molten state and a solvent to an abrupt expansion through a suitable orifice, as described, in particular, in French Pat. Nos. 1,596,107 of Dec. 13, 1968 and 2,148,449 and 2, 148,450 of Aug. 1, 1972, and in Belgian Pat. Nos. 811,778 of Mar. 1, 1974 and 824,844 of Jan. 17, 1975.

As a variant, the fibrils used within the scope of the invention can also be manufactured by other processes, for example by one or other of the processes described in French Pat. Nos. 1,214,157 of June 10, 1958 and 1,472,989 of Sept. 24, 1965, in the name of E. I. du Pont de Nemours and Co. However, in these manufacturing processes, continuous fibrillar rovings are obtained, which should then be cut up, for example by grinding.

In the case where the fibrous, organic polymeric material is in the form of fibers, it is preferable, according to the invention, to use fibers of which the diameter is essentially between 0.1 and 25 microns; very suitable fibers are those having a diameter of between 1 and 15 microns.

According to the invention, the choice of the polymer of the fibrous, organic polymeric material is governed by the need to obtain a diaphragm which resists the chemical and thermal conditions normally prevailing in electrochemical cells. Depending on the intended purpose of the diaphragm, it is possible, for example, to use thermoplastic polymers chosen from amongst polyolefines, polycarbonates, polyesters, polyamides, polyimides, polyphenylenes, polyphenylene oxides, polyphenylene sulphides, polysulphones and mixtures of these polymers.

In general, in the case of diaphragms intended for cells for the electrolysis of sodium chloride brines, fluorinated polymers are preferably used according to the invention.

Polymers containing fluorinated monomeric units derived from ethylene or propylene, preferably polymers containing at least 50%, and more particularly at least 75%, of such monomeric units, are advantageously chosen. Particularly suitable polymers are those which only contain monomeric units derived from ethylene or propylene in which all the hydrogen atoms have been substituted by chlorine or fluorine atoms.

By way of example, polymers which are suitable in the case where the diaphragm according to the invention is intended for the electrolysis of sodium chloride brines are those chosen from amongst polytetrafluoroethylene, polychlorotrifluoroethylene, polyvinylidene fluoride, copolymers of ethylene and chlorotrifluoroethylene, copolymers of ethylene and tetrafluoroethylene, copolymers of tetrafluoroethylene and perfluoroalkyl-vinyl-ether, copolymers of chlorotrifluoroethylene and vinylidene fluoride, copolymers of hydropentafluoropropylene and vinylidene fluoride, copolymers of hexafluoroisobutylene and vinylidene fluoride and sulphonylated copolymers of tetrafluoroethylene and perfluorovinyl ether.

The organic liquid used in the manufacture of the diaphragm according to the invention can be any organic product which, under the working conditions employed for manufacturing the porous sheet, is liquid and does not substantially modify the fibrous structure of the organic polymeric material, in particular the structure of the fibrils in the case where the fibrous, organic polymeric material consists of fibrils. The organic liquid can therefore consist of an organic product which is normally liquid or gaseous under normal pressure and temperature conditions. In the case where an organic product is used which is gaseous at the working temperature employed for manufacturing the porous sheet, the process should obviously be carried out under pressure in an autoclave.

In the case where the fibrous polymeric material is chosen from amongst fluorinated polylmers, halogenohydrocarbons, for example chlorohydrocarbons or fluorohydrocarbons, are advantageously used according to the invention. The halogenohydrocarbons are advantageously chosen from amongst saturated acyclic hydrocarbons and ethylenic hydrocarbons, such as, for example, trichloroethylene, perchloroethylene, 1,1,1-trichloroethane, methylene chloride, carbon tetrachloride and trichlorotrifluoroethane.

The organic liquid can be used in the pure state or, as a variant, it can be slightly diluted with water or another miscible medium. In general, the amount of water or other miscible medium mixed with the organic liquid cannot exceed 10% of the weight of the pure organic liquid; it is preferably less than 5% of the weight of the pure organic liquid.

It is preferred, according to the invention, to choose a fibrous, organic polymeric material and an organic liquid, the respective solubility parameters of which differ from one another by less than 5 $(cal/cm^3)^{\frac{1}{2}}$,the solubility parameter of a substance being, by definition, the square root of its cohesion energy per unit volume (Kirk-Othmar, Encyclopedia of Chemical Technology, 1971, Supplement Volume, page 889). The fibrous polymeric material and the organic liquid are advantageously chosen so that the differencebetween their respective solubility parameters is between 1.5 and 3 $(cal/cm^3)^{\frac{1}{2}}$, the solubility parameter of the organic liquid preferably being greater than that of the fibrous polymeric material.

All other things being equal, the ability of the diaphragm according to the invention to be wetted by aqueous electrolytes, in particular by sodium chloride brines, is considerably improved if the surface tension of the organic liquid chosen does not exceed 40 dynes/cm and is preferably less than 30 dynes/cm, as is the case, for example, of carbon tetrachloride or 1,1,2-trichloroethane.

According to the invention, the dispersion of the fibrous, organic polymeric material in the organic liquid is advantageously adjusted so that the proportion of polymeric material in the resulting suspension is between 0.2 and 25%, preferably between 0.5 and 15%, by weight. Proportions of between 1 and 10% by weight are very suitable.

According to the invention, it is also advantageous to beat the suspension, the purpose of which is to disperse the fibrous polymeric material in the organic liquid and to impart, with the aid of the organic liquid, an intrinsic mechanical cohesion to the porous sheet obtained after decantation or filtration of the organic liquid. In general, the beating intensity is adjusted so that the sheet thus obtained possesses a cohesion which is sufficient to permit its use as a diaphragm in an electrolysis cell. Suitable values for the beating intensity are those which impart, to the suspension of fibrous polymeric material in the organic liquid, a dispersion state corresponding to a Schopper-Riegler number of between 20 and 80, preferably 30 and 75, as defined in Standard Specifications SCAN-M3:65 and TAPPI T227m-58.

The beating intensities required to obtain these values of the Schopper-Riegler number depend on various factors including the nature of the fibrous polymeric material and of the organic liquid, and also the concentration and the temperature of the suspension subjected to beating. These intensities can easily be determined, in each particular case, by routine work.

During beating, the organic suspension of fibrous polymeric material can be kept at a temperature which is lower than, equal to or greater than ambient temperature. In general, the temperature of the suspension should at all times be kept at a temperature above the melting point of the organic liquid and below the softening point of the fibrous polymeric material. Furthermore, the temperature and the pressure should be adjusted during beating in order to prevent vaporization of the organic liquid. In general, temperatures of between 15° and 100° C. are very suitable.

For beating the suspension of fibrous polymeric material, it is possible, for example, to use a pulper of the type commonly used in the papermaking industry, a model of which is described, by way of example, in the treatise "Pulp and Paper Manufacture", Volume III, Mc Graw-Hill Book Company, 1970, page 156.

In order to form the porous sheet, it suffices, in a manner which is in itself known, to decant or filter the suspension which has been beaten. For example, for this purpose, the sheet can be formed on a perforated cloth from which the sheet is then removed and placed, after drying, as a diaphragm in an electrochemical cell.

According to the invention, the sheet is preferably formed by filtering the abovementioned suspension directly through a perforated support for the diaphragm, applying a technique of the type commonly used for the manufacture of asbestos diaphragms and described, in particular, in U.S. Pat. Nos. 1,865,152, in the name of K. E. Stuart, of June 28, 1932, and 3,344,053, in the name of NEIPERT et al., of May 4, 1964. The perforated support for the diaphragm can advantageously be the perforated cathode of an electrolysis cell of the diaphragm type. This embodiment exhibits the advantage that it permits the manufacture of the diaphragm in situ on cathodes of complicated shape, with a non-developable surface, for example of the type equipping the electrolysis cells described in French Pat. Nos. 2,223,083, of Mar. 28, 1973 and 2,248,335 of Oct. 14, 1974.

According to a preferred variant of this embodiment of the sheet for the diaphragm according to the invention, the suspension of fibrous polymeric material is beaten and then filtered through the perforated support in a single device which is in itself known for the manufacture of asbestos diaphragms and is of the type described in French Pat. No. 2,308,702 of Apr. 25, 1975.

In the particular case where this embodiment of the invention is applied to the manufacture of the diaphragm in situ on a cathodic lattice cut in the shape of parallel fingers, for example of the type equipping the electrolysis cells described in the abovementioned French Pat. Nos. 2,223,083 and 2,248,335, it is desirable to use the technique described in U.S. Pat. No. 3,970,041, filed on Apr. 2, 1975 in the name of Morton S. Kircher, which consists in inserting separating elements between the succeessive cathodic fingers during the formation of the porous sheet for the diaphragm.

According to the invention, the sheet is advantageously dried after it has been formed. Any known drying technique, such as drying at ambient temperature, without air circulation, or with suction, can be used for this purpose. However, it is preferred, within the scope of the invention, to dry the sheet by heating it at a temperature above 80° C. but below the softening point of the polymeric material. The drying time must be sufficient for the residual proportion of organic liquid in the sheet to be brought below 5%, preferably below 2%, by weight.

According to an advantageous variant of the invention, after the sheet has been dried, it is heated at a temperature above 100° C. but below the softening point of the fibrous polymeric material. In the case where the latter is chosen from amongst fluorinated polymers and fluorinated copolymers, heating is advantageously carried out at 200° C. or above for at least 1 hour, preferably at least 10 hours. Suitable heating temperatures are about 5° to 15° C. lower than the softening point of the fibrous polymeric material.

The diaphragm according to the invention exhibits the advantage that it has a good mechanical cohesion and stable dimensions during its use in an electrochemical cell. It possesses the advantageous property of an excellent ability to be wetted by aqueous electrolytes, in particular by sodium chloride brines.

In an advantageous embodiment of the invention, the abovementioned porous sheet resulting from drying and heating is subjected to a treatment with a liquid of which the surface tension does not exceed 40 dynes/cm and is preferably less than 30 dynes/cm.

The diaphragm according to this particular embodiment of the invention is characterised by an optimum wettability with respect to aqueous electrolytes, in particular aqueous solutions of alkali metal halides, such as sodium chloride brines.

In this preferred embodiment of the invention, the treatment of the porous sheet with the liquid of low surface tension can be carried out by any known impregnating technique, for example by washing or immersion. However, the treating liquid is preferably percolated through the porous sheet.

In general, the treatment of the sheet with the liquid of low surface tension can be carried out at low temperature, at ambient temperature or at high temperature, under a pressure which is less than, equal to or greater than atmospheric pressure.

The liquid of low surface tension can be any organic or inorganic liquid which, under the conditions of treatment of the sheet, has a surface tension of not more than 40 dynes/cm and does not substantially modify the fibrous structure of the organic polymeric material of the sheet.

Liquids of low surface tension which are very particularly suitable within the scope of the invention are those of which the surface tension is between 10 and 30 dynes/cm, for example acetone, ethyl alcohol, methyl alcohol, isopropyl alcohol, chloroform, diethyl ether, carbon tetrachloride and ammonia.

As a variant, it is also possible to use aqueous solutions possessing the required surface tension, for example water containing a sufficient amount of a surface-active agent to bring its surface tension to at most 40 dynes/cm, preferably less than 30 dynes/cm.

In addition to the abovementioned advantageous properties, the diaphragm according to the invention exhibits the particularly valuable characteristic that it generally has a permeability to aqueous electrolytes which is of the same order of magnitude as the permeability of the asbestos diaphragms normally equipping cells for the electrolysis of sodium chloride brines, with the result that it is very suitable as a substitute for the asbestos diaphragms in existing electrolysis cells, for example in the type of cell described in French Pat. Nos. 2,164,623 of Dec. 12, 1972, 2,223,083 of Mar. 28, 1973, 2,230,411 of Mar. 27, 1974 and 2,248,335 of Oct. 14, 1974.

The diaphragm according to the invention furthermore exhibits the valuable and surprising characteristic that, as from the time when it is first used, it has the optimum wettability and permeability required. This characteristic of the diaphragm according to the invention offers the appreciable advantage that electrochemical installations, in particular cells for the electrolysis of sodium chloride brines, will henceforth be capable of functioning under normal operating conditions with an optimum energy efficiency, as from the time when they are first brought into service with a new diaphragm.

The diaphragm according to the invention is suitable both for equipping electrochemical batteries used for the production of electrical energy and for equipping electrolysis cells. It finds a valuable application in cells of the diaphragm type for the electrolysis of aqueous solutions of alkali metal halides, in particular sodium chloride brines.

In a particularly valuable embodiment of the diaphragm according to the invention, which embodiment is very suitable for the electrolysis of sodium chloride brines, the specific surface area of the porous sheet for the diaphragm is between 0.5 and 40 $m^2/g$, preferably between 1.5 and 20 $m^2/g$; furthermore, its permeability is advantageously between 0.02 and 1 $hour^{-1}$, preferably between 0.05 and 0.5 $hour^{-1}$, the permeability of the porous sheet being defined by the flow (in $cm^3$/hour) of saturated sodium chloride brine, at 80° C., which passes through a 1 $cm^2$ surface area of the sheet under a hydrostatic pressure corresponding to a 1 cm brine column. Specific surface area values of between 5 and 15 $m^2/g$ and permeability values of between 0.07 and 0.3 $hour^{-1}$ are very particularly suitable if the diaphragm is intended for the electrolysis of concentrated sodium chloride brines.

The appropriate values of the specific surface area and of the permeability of the sheet forming the diaphragm can easily be obtained by judiciously choosing the dimensions of the fibers or of the fibrils forming the fibrous polymeric material, the nature of the organic liquid, the concentration of the suspension subjected to beating and the beating energy employed.

The diaphragm according to the invention can optionally contain, in addition to the fibrous polymeric material, other usual constituents of permeable diaphragms, such as inorganic fibers (for example asbestos fibers) or additives intended to improve certain properties of the diaphragm or to impart additional properties to the diaphragm, for example particles of titanium dioxide or barium titanate, or surface-active agents, which are preferably fluorinated, such as fluorinated or perfluorinated fatty acids, fluorinated or perfluorinated sulphonic acids or salts of these acids.

In order to incorporate these additional constituents into the diaphragm according to the invention, it is possible, for example, to introduce them as such, in the particulate state, into the suspension of the fibrous polymeric material after or, preferably, before beating this suspension. As a variant, it is possible to use a fibrous polymeric material whch already contains such additives as a filler.

The value of the invention will become apparent from the few application examples which follow.

Examples 1 to 6 which now follow relate to diaphragms based on fibrils made from Halar (trademark) polymers (sold by Allied Chemical Corp.), which are copolymers of ethylene and chlorotrifluoroethylene. The fibrils used were obtained by subjecting a two-phase mixture of the polymer in the molten state and a suitable solvent to an abrupt expansion through an orifice of small cross-section as described in French Pat. Nos. 1,596,107 of Dec. 13, 1968 and 2,148,449 and 2,148,450 of Aug. 1, 1972, and in Belgian Pat. Nos. 811,778 of Mar. 1, 1974 and 824,844 of Jan. 17, 1975.

First series of tests (according to the invention)

Examples 1 to 3 which now follow relate to diaphragms according to the invention.

EXAMPLE 1

In order to manufacture the diaphragms, the fibrils, obtained in the manner described above, were dispersed in perchloroethylene so as to form 9 liters of a suspension containing 1% by weight of fibrils. The suspension was beaten for 1 minute 30 seconds, at ambient temperature and atmospheric pressure, in a conventional softening device of the papermaking industry. After beating, the dispersion state of the organic suspension of polymeric material corresponded to a Schopper-Riegler number of between 55 and 60. The suspension was then filtered through a 113 $cm^2$ circular perforated cloth for 3 minutes, a suction of 50 mm being created under the lattice for this purpose. The porous sheet collected on the cloth was dried on the latter by heating at 90° C. for one hour.

The diaphragms collected after drying had a specific surface area of 3 $m^2/g$. When subjected to a tensile test, they possessed, on average, the following mechanical characteristics:

breaking load: 38.1 $kg/cm^2$ elongation at break: 12.2%

One of the diaphragms thus obtained was subjected to an electrolysis test in a laboratory cell. The cell comprised a 113 $cm^2$ circular vertical cathode, formed by a mild steel lattice, and an anode arranged vertically with respect to the cathode and formed by a 113 $cm^2$ circular titanium plate which carried an active coating consisting of an equimolar mixture of ruthenium dioxide and titanium dioxide. The distance between the anode and the cathode was 5 mm and the diaphragm was placed as such on the cathode, opposite the anode.

In the cell equipped with the diaphragm, a brine, containing 255 g of sodium chloride per kg, was electrolysed at 85° C. under a constant current density of 2 $kA/m^2$ of anode. Before starting the electrolysis, the diaphragm possessed a permeability of 0.11 $hour^{-1}$, as defined by the relationship:

$K=Q/(S\times H)$, in which:

Q denotes the flow of brine through the diaphragm (in $cm^3$/hour), S denotes the cross-section of the diaphragm (in $cm^2$) and H denotes the hydrostatic pressure of brine on the diaphragm, expressed in cm of brine column.

The change in the permeability of the diaphragm, the change in the electrolysis voltage, measured at the cell terminals, and the change in the current efficiency have been recorded in Table I below, the caustic soda solution leaving the cell containing 10% by weight of sodium hydroxide.

TABLE I

| Electrolysis time (days) | Permeabilities ($hours^{-1}$) | Voltage (V) | Efficiency (%) |
|---|---|---|---|
| 0 | 0.11 | — | — |
| 1 | 0.09 | 3.58 | 98 |
| 4 | 0.09 | 3.58 | 98 |
| 20 | 0.08 | 3.62 | 98 |
| 100 | 0.07 | 3.45 | 98 |

After the 100 day test period, the diaphragm was still in service.

EXAMPLE 2

The test of Example 1 was repeated, the only difference being that, after drying, the sheet for the diaphragm was heated at 200° C. for 24 hours.

The resulting diaphragms had a specific surface area of 1.9 $m^2/g$. They exhibited the following mechanical characteristics:

breaking load: 93.4 $kg/cm^2$ elongation at break: 31.5%

The electrolysis results are recorded in Table II below.

TABLE II

| Electrolysis time (days) | Permeabilities ($hours^{-1}$) | Voltage (V) | Efficiency (%) |
|---|---|---|---|
| 0 | 0.07 | — | — |
| 1 | 0.07 | 3.80 | 98 |
| 16 | 0.06 | 3.74 | 98 |
| 46 | 0.09 | 3.56 | 91 |

After 46 days, the diaphragm was still in service.

EXAMPLE 3

A diaphragm containing 30% by weight of fibrils and 70% by weight of particles of titanium dioxide was manufactured in the manner described in Example 1. After beating, which lasted 1 minute 30 seconds, the dispersion state of the organic suspension of fibrous polymeric material and of titanium dioxide corresponded to a Schopper-Riegler number of 43.

When subjected to a tensile test, the diaphragm collected after drying exhibited the following mechanical characteristics:

breaking load: 12.4 kg/cm$^2$ elongation at break: 6%

The electrolysis results are recorded in Table III.

TABLE III

| Electrolysis time (days) | Permeability (hours$^{-1}$) | Voltage (V) | Efficiency (%) |
|---|---|---|---|
| 0 | 0.73 | — | — |
| 1 | 0.80 | 3.01 | — |
| 7 | 0.70 | 2.94 | 93 |

After the 7 day test period, the diaphragm was still in service.

The results of the tests of Examples 1 to 3 show that the diaphragms according to the invention possess a good mechanical strength, permitting their normal use in electrolysis. The electrolysis results obtained with such diaphragms are at least comparable to those obtained with the best asbestos diaphragms. Furthermore, it is observed that the permeability of the diaphragms and the electrolysis results remain virtually unchanged throughout the electrolysis time, which makes it possible to cause the cells to function under normal working conditions as from moment when the electrolysis starts.

Second series of tests (comparison tests)

EXAMPLE 4

A diaphragm was manufactured by applying the method described in Example 1; this time, however, water was used in place of perchloroethylene to form the suspension of fibrils, in constrast to the invention. The water used contained 1 % by weight of the product FLUORAD FC-170 (3M Company) which is a fluorinated surface-active agent. The beating time for the aqueous suspension of fibrils was 1 minute 30 seconds, as in the tests of Examples 1 to 3.

When subjected to a tensile test, the diaphragm collected after drying was characterized by a breaking load of 0.2 kg/cm$^2$.

EXAMPLE 5

The test of Example 4 was repeated, but the beating time was extended to one hour in this case.

The diaphragm collected after drying did not possess a greater breaking load than that of the diaphragm of Example 4.

EXAMPLE 6

The test of Example 4 was repeated, the only difference being that, after drying, the sheet for the diaphragm was heated at 200° C. for 24 hours.

The resulting diaphragm possessed a breaking load under tension of 1.2 kg/cm$^2$.

The value of the invention is immediately made apparent by comparing the results of Example 1 to 3 with those of Examples 4 to 6.

We claim:

1. A method for the manufacture of chlorine and hydrogen gases comprising electrolyzing an aqueous solution of alkali metal chloride in an electrolytic cell containing a permeable diaphragm comprised of a porous sheet of a fibrous organic polymeric material obtained from a suspension of the fibrous polymeric material in an organic liquid.

2. A method according to claim 1, in which the fibrous polymeric material consists of fibrils.

3. A method according to claim 1, in which the fibrous polymeric material consists of a fluorinated polymer.

4. A method according to claim 1, in which the fibrous polymeric material and the organic liquid are chosen so that the difference between their respective solubility parameters is less than 5 (cal/cm$^3$)$^{\frac{1}{2}}$.

5. A method according to claim 1, in which the organic liquid is chosen from amongst those having a surface tension of at most 40 dynes/cm.

6. A method according to claim 1, in which the organic liquid is chosen from amongst halogenohydrocarbons.

7. A method according to claim 1, in which said diaphragm is obtained from a suspension of the fibrous polymeric material in the organic liquid, containing from 1 to 10% by weight of fibrous polymeric material.

8. A method according to claim 1, in which said diaphragm is obtained by beating the suspension of fibrous polymeric material so that it possesses a Schopper-Riegler number of between 30 and 75.

9. A method according to claim 1, in which said diaphragm is obtained by drying the sheet, and then heating said sheet at 100° C. or above for at least one hour, and then treating said sheet with a liquid having a surface tension of at most 40 dynes/cm.

10. A method according to any one of claims 2 to 9, or 1, in which the specific surface area of said diaphragm is between 5 and 15 m$^2$/g and its permeability, expressed by the flow, in cm$^3$/hour, of saturated sodium chloride brine, at 80° C., passing through a 1 cm$^2$ surface area of the diaphragm under a hydrostatic pressure corresponding to a 1 cm brine column, is between 0.07 and 0.3.

11. A method according to claim 1 on which said diaphragm consists essentially of fibrils of a fluorinated polymer.

12. A method according to one of claims 2, 3 or 11 in which the fibrous polymeric material and the organic liquid are chosen so that the difference between their respective solubility parameters is less than 5 (cal./cm.-$^3$)$^{\frac{1}{2}}$.

13. A method according to one of claims 2, 3, 4 or 11 in which the organic liquid has a surface tension of at most 40 dynes/cm.

14. A method according to one of claims 2, 3, 4, 5 or 11 in which the organic liquid is a halogenohydrocarbon.

15. A method according to one of claims 2, 3, 4, 5 or 6 in which said diaphragm is obtained from a suspension of the fibrous polymeric material in the organic liquid containing from 1 to 10% by weight of fibrous polymeric material.

16. A method according to one of claims 2, 3, 4, 5, 6 or 7 in which said diaphragm is obtained by beating the suspension of fibrous polymeric material so that it possesses a Schopper-Riegler number between 30 and 75.

17. A method according to one of claims 2, 3, 4, 6, 7, 8 or 11 in which said diaphragm is obtained by drying the sheet and then heating said sheet to at least 100° C. for at least one hour and then treating said sheet with a liquid having a surface tension of at most 40 dynes/cm.

* * * * *